US005562038A

United States Patent [19]

Bierbaum et al.

[11] Patent Number: 5,562,038

[45] Date of Patent: Oct. 8, 1996

[54] METHOD AND APPARATUS FOR PIVOTING A BIDIRECTIONAL PIVOT FRAME

[75] Inventors: Günter J. Bierbaum, Hettstadt; Klaus W. Röder, Würzburg, both of Germany

[73] Assignee: Koenig & Bauer-Albert Aktiengesellschaft, Wurzburg, Germany

[21] Appl. No.: 559,142

[22] Filed: Nov. 17, 1995

[30] Foreign Application Priority Data

Nov. 18, 1994 [DE] Germany ..... 44 41 142.1

[51] Int. Cl.[6] ..... B41L 15/14

[52] U.S. Cl. ..... 101/483; 101/228; 226/1; 226/21; 226/46

[58] Field of Search ..... 101/227, 228, 101/483; 226/1, 12, 21, 46, 91, 92, 190; 242/58, 58.1, 58.2, 58.3, 58.4

[56] References Cited

U.S. PATENT DOCUMENTS

| | | | |
|---|---|---|---|
| 1,904,536 | 4/1933 | Richter . | |
| 3,670,645 | 6/1972 | Hill | 101/227 |
| 3,749,013 | 7/1973 | Ellner | 101/228 |
| 3,995,791 | 12/1976 | Schoppee | 242/58.1 |
| 4,763,851 | 8/1988 | Flament . | |
| 4,767,075 | 8/1988 | Peters et al. | 242/56.4 |
| 4,993,652 | 2/1991 | Moeller | 242/56 R |
| 5,003,889 | 4/1991 | Glunz et al. | 101/228 |
| 5,344,089 | 9/1994 | Crowley et al. | 242/58.1 |

FOREIGN PATENT DOCUMENTS

| | | |
|---|---|---|
| 2587982 | 4/1987 | France . |
| 2259734 | 8/1982 | Germany . |

*Primary Examiner*—Eugene H. Eickholt
*Attorney, Agent, or Firm*—Jones, Tullar & Cooper, P.C.

[57] ABSTRACT

A bidirectional pivot frame of a paper web changing device is supported for pivotal motion about a selected one of two pivot axes. The support for the pivot frame is accomplished by slidable locking supports that positively lock one set of pivot pins in place in guide slots in the side frames of the paper web changing device, while releasing a second set of guide pins. The slidable locking supports are shiftable to selectively positively lock the desired set of guide pins in place.

6 Claims, 3 Drawing Sheets

METHOD AND APPARATUS FOR PIVOTING A BIDIRECTIONAL PIVOT FRAME

FIELD OF THE INVENTION

The present invention is directed generally to a method and apparatus for pivoting a bidirectional pivot frame. More particularly, the present invention is directed to a method and apparatus for pivoting a bidirectional pivot frame of a paper roll changing device. Most specifically, the present invention is directed to a method and apparatus for pivoting a bidirectional pivot frame of a paper roll changing device in which the pivot frame can be seated in two different operating positions. The bidirectional pivot frame carries pressure rollers at each of its spaced ends with these pressure rollers being usable to guide a paper web from an exhausting roll into contact with a surface of a full web roll. The two pressure rollers are each supported between lateral frame elements and these lateral frame elements are each pivotable about two selectable pivot axes which are spaced apart from each other.

DESCRIPTION OF THE PRIOR ART

It is generally well known in the printing art that it is necessary, in the field of web-fed rotary presses, to accomplish web changes on the fly. The paper web being printed is fed to the press from one of several paper web supply rolls that are rotatably supported in a paper roll changing device. As one roll begins to become exhausted, the paper web from that roll is moved into contact with an appropriately prepared leading end of a paper web on a full supply roll which has been brought up to the correct operating speed. The exhausting web is pressed by suitable pressure rollers against the leading end of the fresh roll during a so-called flying web splice.

One device that is usable to connect a running paper web from an exhausting supply roll with the leading end of a paper web on a new supply roll is shown in German Patent Publication DE 22 59 734 C2. In the course of accomplishing the connection of the two webs, the web from the exhausting roll is pressed against the surface of the full supply roll by the use of one of two pressure rollers which are seated or supported near the ends of a bidirectional pivot frame. Depending on whether the fresh paper supply roll, that is to be connected to the exhausting web, is located to the right or to the left of the exhausting roll, the bidirectional pivot frame will pivot around either the shaft of the first or second pressure roller. The bidirectional pivot frame is seated by means of pneumatically actuable pin-shaped bars that are disposed in the side frames. These bars enter into bores in the bidirectional pivot frame.

One limitation of this prior art device is that it is possible to release the pivot frame on both of its sides, from the side frames. If there is a malfunction in the controls for the pneumatic pin-shaped bars, it is possible that the bidirectional pivot frame can be released on both sides or ends. This will allow the pivot frame to move into a position where it will interfere with the feed of the paper web from the supply roll. This unintended release of the bidirectional pivot frame could also result in damage to the press and interference with its operation.

It will be seen that a need exists for a device for pivoting a bidirectional pivot frame in a paper roll changer that overcomes the limitations of the prior art device. The method and apparatus for pivoting a bidirectional pivot frame in accordance with the present invention provides such a device and is a significant improvement over the prior art.

SUMMARY OF THE INVENTION

It is an object of the present invention to provide a method and apparatus for pivoting a bidirectional pivot frame.

Another object of the present invention is to provide a method and apparatus for pivoting a bidirectional pivot frame of a paper roll changing device.

A further object of the present invention is to provide a method and apparatus for pivoting a bidirectional pivot frame of a paper roll changing device in which the pivot frame can be seated in two operating positions.

Still another object of the present invention is to provide a bidirectional pivot frame having two pressure rollers and two selectively releasable pivot shafts or axes.

Yet a further object of the present invention is to provide a bidirectional pivot frame whose inadvertent release from both pivot axes or positions is not possible.

As will be set forth in detail in the description of the preferred embodiment, which is presented subsequently, the bidirectional pivot frame of a paper web changing device in accordance with the present invention uses two laterally spaced frames to each support ends of two separate pressure rollers. These two pressure rollers are each selectively usable to press a paper web, from an exhausting paper supply roll, into surface contact with a leading end of a paper web on a fresh supply roll. The two lateral frames are each provided with several spaced pivot pins that are receivable in guide slots in the side frames of the roll changer. Depending on the relative locations of the exhausting paper roll and the fresh supply roll, the lateral frames of the bidirectional pivot frame will pivot about those pivot pins which are situated at either one the two ends of the lateral frames. Suitable locking supports are movable horizontally in the side frames in response to which ones of the pivot pins are acting as the pivot shafts or axes for the pivot frame. These locking supports prevent the inadvertent displacement of the active pivot pins from their frame guide slots during pivoting of the pivot frame. Suitable locking bolts that are carried by linear guides are also provided. These locking bolts prevent the horizontally shiftable locking supports from being inadvertently shifted.

The bidirectional pivot frame in accordance with the present invention, and its method of operation, insures that one end of the lateral frames will be positively secured in place during any operation of the paper roll changing device. This means that it will not be possible for the bidirectional pivot frame to become disengaged at both ends of the lateral frames from the press side frames. This will insure that press damage will be prevented and that the operational dependability of the bidirectional pivot frame will be increased.

The method and apparatus for pivoting a bidirectional pivot frame in accordance with the present invention overcomes the limitations of the prior art. It is a substantial advance in the art.

BRIEF DESCRIPTION OF THE DRAWINGS

While the novel features of the method and apparatus for pivoting a bidirectional pivot frame in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
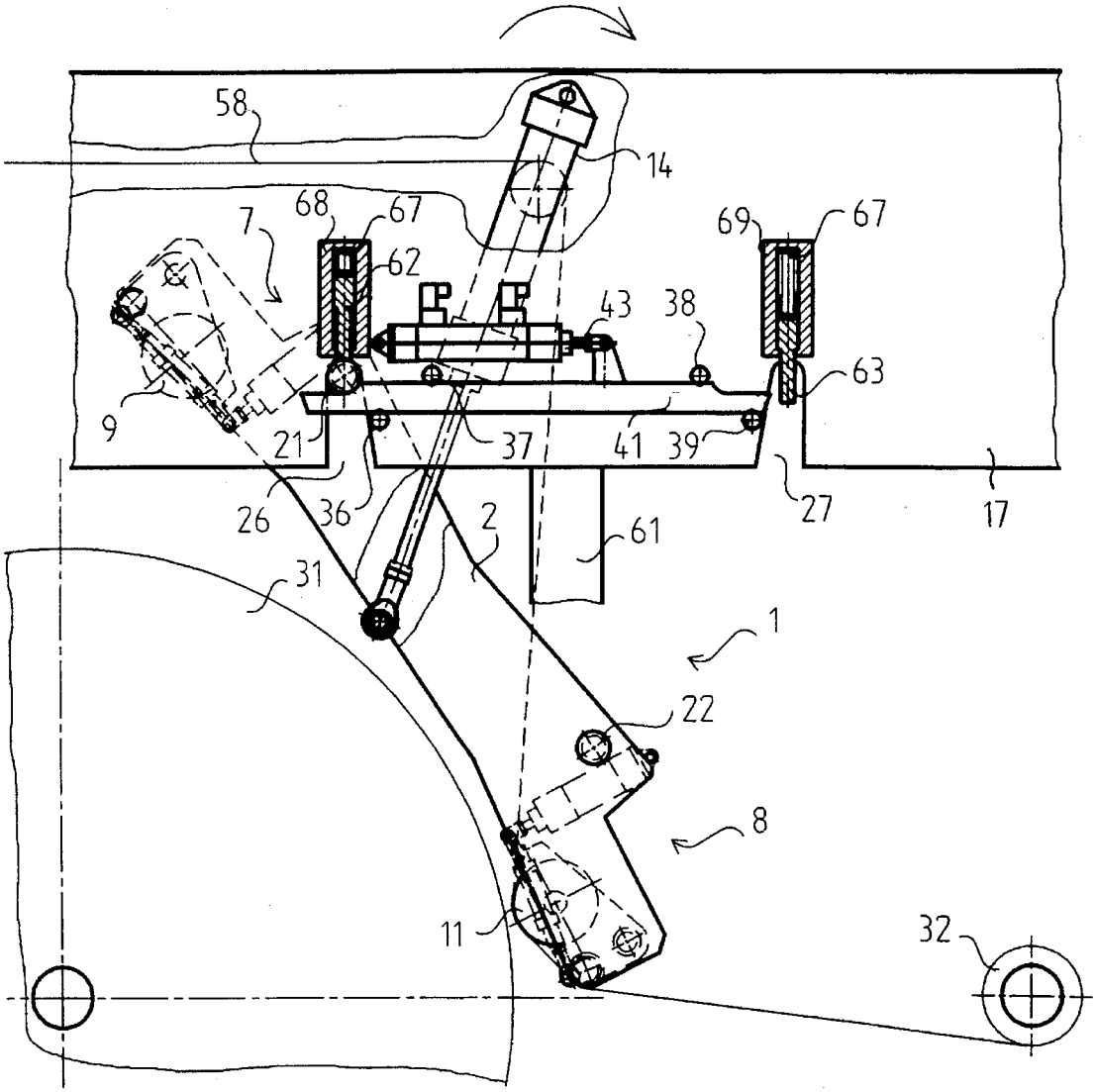
FIG. 1 is a side elevation view, partly in section of a bidirectional pivot frame with a locking device in accordance with the present invention and showing the pivot frame in a left working position.
Figure 2:
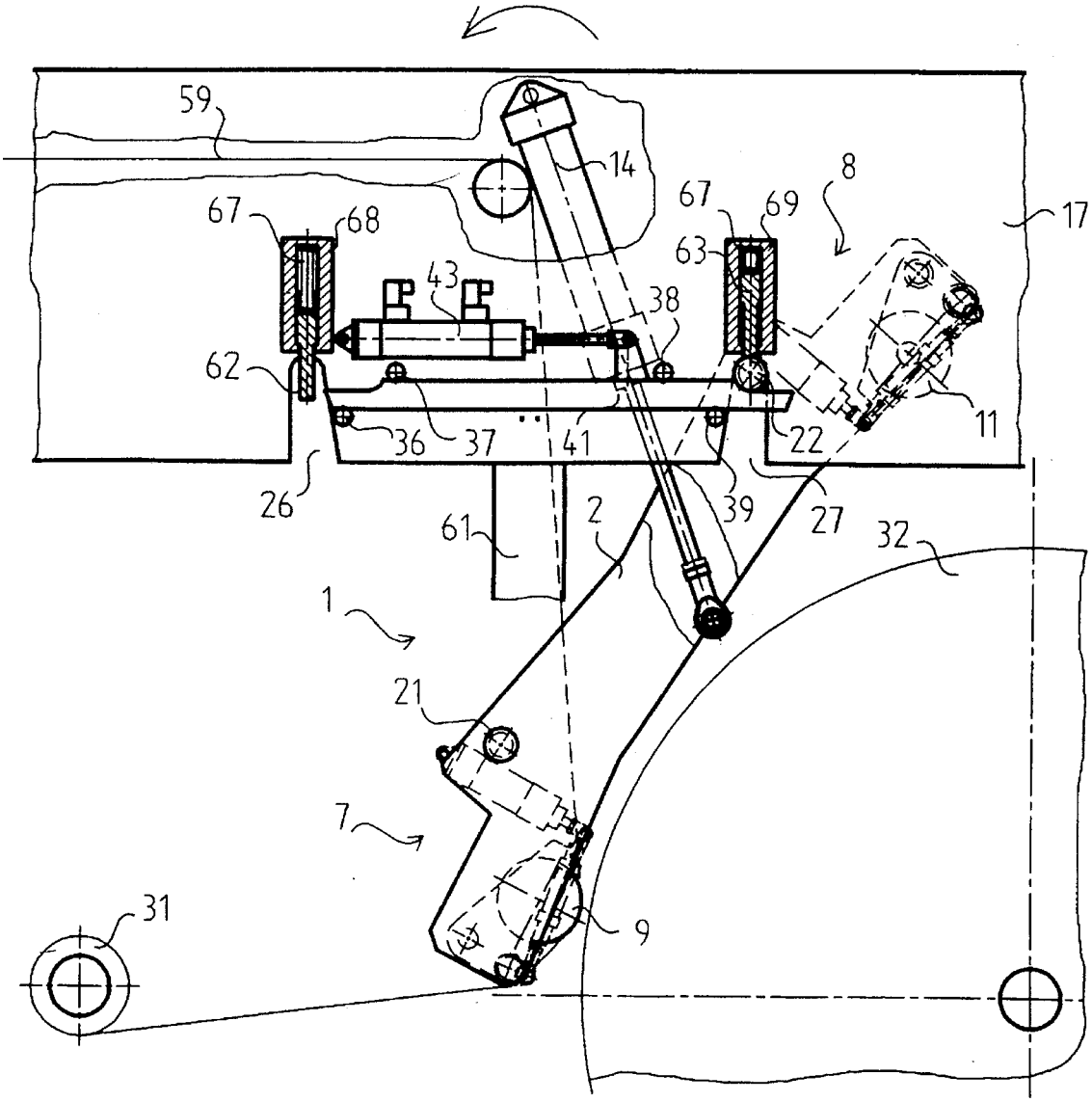
FIG. 2 is a view similar to FIG. 1 and showing the bidirectional pivot frame in a right working position.

Referring initially primarily to FIGS. 1 and 2, there may be seen a preferred embodiment of a bidirectional pivot frame, generally at 1, for a paper roll changing device in accordance with the present invention. The paper roll changing device is generally conventional and is used to support at least two paper webs or paper supply rolls 31 and 32, which are used to supply a paper web to a web-fed printing press. The printing press is also generally conventional and itself forms no part of the present invention.

The bidirectional pivot frame 1 is formed by two oppositely disposed, and parallel spaced lateral frame elements 2 and 3. These lateral frame elements 2 and 3 are connected to each other by two spaced cross arms 4 and 6. The lateral frame elements 2 and 3 and the two spaced cross arms 4 and 6 form a generally rectangular box frame. The two lateral frame elements 2 and 3 are situated generally parallel to the spaced side frames 17 and 18 of the paper roll changing device, as may be seen in FIG. 3. The two cross arms 4 and 6 extend between left and right, or first and second ends 7 and 8, as viewed in FIGS. 1–3, of the lateral frame elements 2 and 3 and are generally parallel to axes of rotation of the paper supply rolls 31 and 32. A first or left end pressure roller 9 is supported for rotation between the left ends 7 of the two lateral frame elements 2 and 3. In a similar fashion, a second or right pressure roller 11 is supported for rotation between the right ends 8 of the two lateral frame elements 2 and 3. These pressure rollers are seated in a manner as is known generally from the German document No. DE 42 18 825 A1. These pressure rollers 9 and 11 can be pivotable with respect to the two lateral frame elements 2 and 3, and can be combined with cutting cylinders 12 and 13, which are shown in FIGS. 1, 2 and 4. These cutting cylinders are generally conventional and are used to sever the leading end of the exhausting web after a splice to a trailing end of a fresh paper supply roll has been accomplished.

The bidirectional pivot frame 1 can be pivoted in both clockwise as well as counterclockwise directions by actuation of two synchronously actuable pivot frame work cylinders, which may be, for example, pneumatic cylinders 14 and 16. The cylinder ends of the two pneumatic pivot frame work cylinders 14 and 16 are pivotably seated on the lateral frames 17 and 18, respectively, of the paper roll changing device, and the piston rod ends of the two pneumatic cylinders 14 and 16 are connected at the centers of the lateral frame elements 2 and 3, respectively. Pivot pins 21, 22, 23 and 24, which are pointing in the direction toward the lateral frames 17 and 18, are connected with each lateral pivot frame element 2 and 3. The cross arms 4 and 6 can have such pivot pins 21 to 24 formed as their ends which are projecting through the lateral pivot frame elements 2 and 3. The pivot pins 21 to 24 interlockingly engage guides 26–29 in the lateral frames 17 and 18. These guides 26–29 are embodied as slots or recesses extending in the vertical direction and which are open at the bottom of each recess 26–29 in the direction toward the paper supply rolls 31 and 32. These guides or guide slots 26–29 are closed at their tops. The guides or guide slots 26 and 27 in the side frame 17 can be seen in FIGS. 1, 2 and 4. The pivot pins 21–24 can be seen in FIG. 4 whereas only pivot pins 21 and 22 for the lateral pivot frame element 2 are shown in FIGS. 1 and 2. The guides 26 to 29 in the side frames 17 and 18 are slightly greater in width than the width of the pivot pins 21–24 and at times receive the pivot pins 21 to 24.

One locking device 33 or 34 is disposed on the outside of each lateral side frame 17 and 18. Each locking device 33 or 34 consists of locking support 41 or 42, respectively, which is seated in a frictionally connected manner between guide rollers 36, 37, 38, 39, or 46, 47, 48, 49 that are fixed in place on the lateral frames 17 and 18. Each locking support 41 or 42 can be slid back and forth in the horizontal direction on the guide rollers 36 to 39 and 46 to 49 and are both secure against pivoting. The locking supports 41 and 42 are each horizontally displaceable by use of a horizontally seated work cylinder, for example a pneumatic cylinder 43 or 44, that is seated on the lateral frames 17 or 18. The pivot pins 21 to 24, received in the guides 26 to 29, are maintained in their position of rest by means of the ends 51, 52, and 53, 54 of the locking supports 41, 42 as may be seen in FIGS. 3 and 4. The ends 51–54 of both locking supports 41 and 42 are respectively located below the centers of the pivot pins 21 to 24, while the piston rods of the pneumatic cylinders 43, 44 are in a center position, as shown in FIG. 4. An active operating length "l" of each locking support 41 or 42 is greater than the spacing distance "b" between the centers of the pivot pins 21 and 22 or 23 and 24. The pivot pins 21 and 22 or 23 and 24 rest in pairs on the locking supports 41 and 42 and, as will be explained below, can cooperatively form a momentary or temporary pivot shaft or axis 56 or 57 in their work position. Both momentary or temporary pivot shafts or axes 56, 57 are also at a distance "b" between each other.

Referring now again to FIGS. 1 and 2, the two alternate work positions of the bidirectional pivot frame 1, in accordance with the present invention, can be seen. In the left work position, as depicted in FIG. 1, the pivot pins 21 and 23 are held in the side frame guide slots 26 and 28 by the locking supports 41 and 42 which have been shifted to the left. In this position, a running paper web 58 from a right exhausting supply roll 32 is to be joined to a leading end of a left rotating paper web roll 31. In the right working position, as shown in FIG. 2, the pivot pins 22 and 24 are held in the guide slots 27 and 29 by the locking supports 41 and 42 which have been shifted to the right. In this position, a paper web 59 from a left exhausting paper supply roll 31 is to be joined to a right rotating paper web roll 32.

Figure 3:
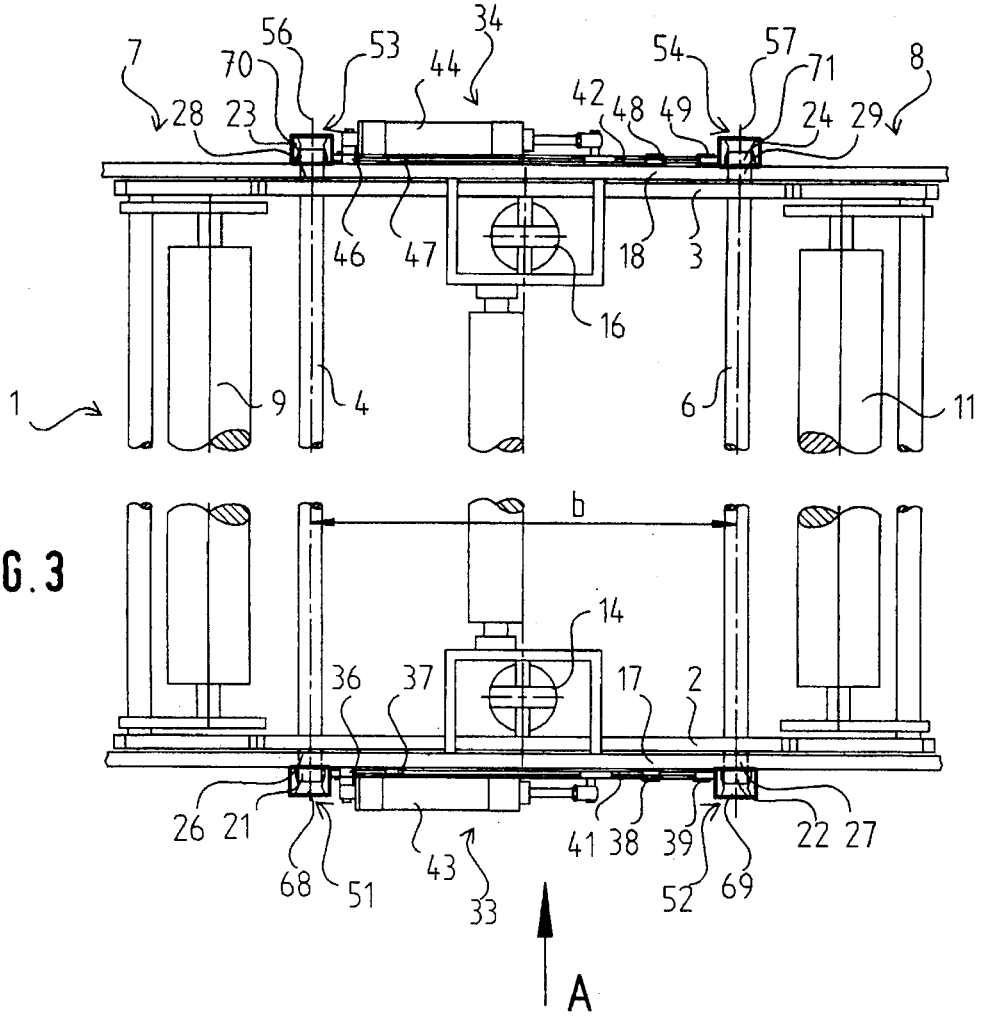
FIG. 3 is a top plan view of the bidirectional pivot frame in its rest position and with a cutting cylinder, paper rolls and paper web removed for ease of illustration.
Figure 4:
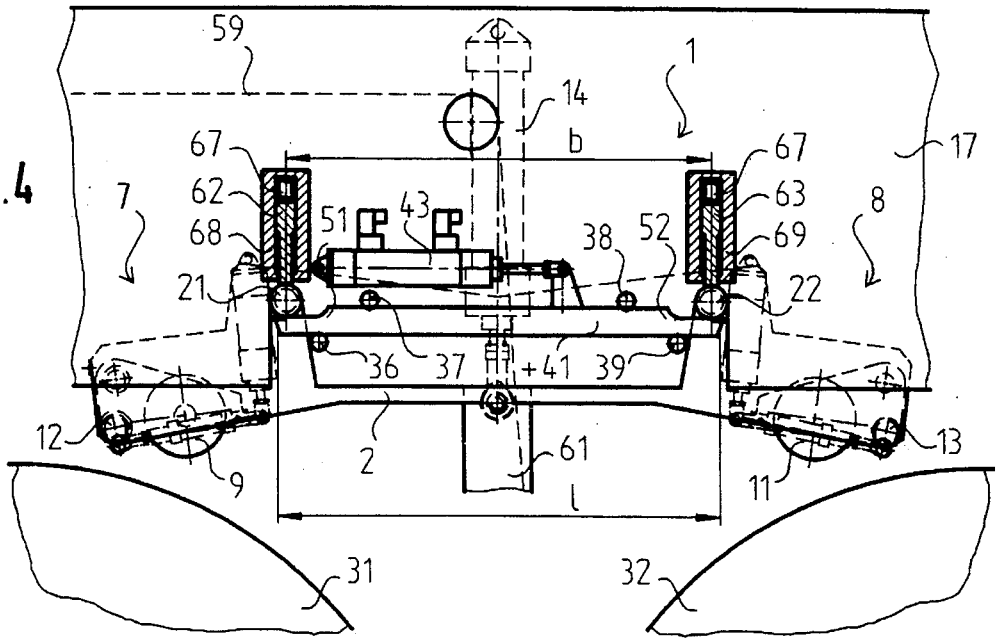
FIG. 4 is a partial side elevation view of the bidirectional pivot frame, taken in the direction indicated by arrow A in FIG. 3 and showing the pivot frame in its rest position.

Returning to FIG. 1, in order to shift the bidirectional pivot frame 1 from its neutral or rest position, as shown in FIGS. 3 and 4 to its left working position, as shown in FIG. 1 the following steps are performed. The piston rod for each locking device work cylinder 43 and 44 is retracted and the length of the stroke of the pneumatic cylinders 43 and 44 is shortened from their center positions, as shown in FIGS. 3 and 4, into a left end position. In the process, both locking supports 41 and 42 move in the direction toward the first or left end 7 of the bidirectional pivot frame 1, so that the bearing points 22, 27 and 24, 29 on the right temporary or momentary pivot shaft or axis 57, located on the second end 8 of the bidirectional pivot frame 1, are unlocked and the bearing points 21, 26 and 23, 28 on the left temporary or momentary pivot shaft or axis 56, located on the first end 7 of the bidirectional pivot frame 1, can be simultaneously locked in the process. The bidirectional pivot frame 1 can now be pivoted around its left temporary or momentary pivot shaft or axis 56 when the pneumatic pivot frame work cylinders 14 and 16 extend their piston rods, as depicted in FIG. 1. The second or right end pressure roller 11 of the bidirectional pivot frame 1 performs the connection of the paper webs of both paper rolls 31 and 32.

Since an active length "l" of the locking supports 41 and 42 is greater than a distance "b" between the centers of the pivot pins 21, 22 and 23, 24 resting on them, it is positively assured that pivoting of the bidirectional pivot frame 1 toward the paper supply roll 31 can take place only if the seating 21, 26 and 23, 28 of one pivot shaft or axis 56 is assured. In other words, the bidirectional pivot frame 1 can assume the position depicted in FIG. 1 only if the locking supports 41 and 42 of the locking devices 33 and 34 have been slid fully to the left, as depicted in FIG. 1. If such a complete shifting has not occurred, the right end 8 of the lateral frames 2 and 3 of the bidirectional pivot frame 1 will not be released since the pivot pins 22 and 24 will not be able to drop out of the pivot pin guide slots 27 and 29. Full shifting of the locking supports 41 and 42 to the left, as viewed in FIG. 1, will free the pins 22 and 24 so that they can drop out of the pin guide slots 27 and 29. Thus the bidirectional pivot frame 1 will pivot about its temporary or momentary pivot shaft or axis 56 because the pivot pins 21 and 23 are supported in their guide slots 26 and 28 by the left ends of the left shifted locking supports 41 and 42.

If now the bidirectional pivot frame 1 is to be brought from its position of rest as shown in FIGS. 3 and 4, toward the right, i.e. in a counterclockwise direction, into a right work position, as shown in FIG. 2, in which a running paper web 59 of a left emptied paper supply roll 31 is to be connected with a right rotating paper web roll 32, the locking supports 41 and 42 are slid in the direction of the second or right end 8 of the bidirectional pivot frame 1, in a manner analogous to that discussed previously, so that the seating points 22, 27 and 24, 29 of a right temporary or momentary pivot shaft or axis 57, located on the second end 8 of the bidirectional pivot frame 1, are locked and the seating points 21, 26 and 23, 28 of the left temporary or momentary pivot shaft or axis 56, located on the left or first end 7 of the bidirectional pivot frame 1, are simultaneously unlocked in the process. In this way, pivoting of the bidirectional pivot frame 1 around the right momentary pivot shaft 57 can take place, wherein the first pressure roller 9 of the bidirectional pivot frame 1 performs the connection of the paper webs of both paper rolls 31 and 32.

The slidable locking supports 41 and 42 are disposed to be shiftable together in such a way that either the left pair of pivot pins 21 and 23 or the right pair of pivot pins 22 and 24 are completely released only if, at the same time the respective, not-released right pair of pivot pins 22 and 24 or the left pair of pivot pins 21 and 23 must positively rest in its guide slots 27 and 29 or 26 or 28 and be restrained by the locking supports 41 and 42. The guide slots 26 to 29 can have the shape of an inverted, i.e. rotated by 180°, letter U, wherein both legs can also widen toward the bottom. The lateral side frames 17 and 18 can also consist of a scaffolding disposed on supports 61, as is shown in FIGS. 1, 2 and 3. The pneumatic cylinders 14, 16, 43 and 44 can be embodied as double-acting work cylinders, whose connections and controls are not represented and whose actuation can take place from a press control console, not shown.

To provide further dependability to the device, it is furthermore possible to install on the outside of the lateral frames 17 and 18 above the guide slots 26, 28 or 27, 29 for the pivot pins 21, 23 or 22, 24, linear guides 68, 70 or 69, 71, respectively. Locking bolts 62, 64 or 63, 65 respectively, and which are shown in section in FIGS. 1, 2 and 4, are moved parallel with the vertically extending longitudinal axes of the guide slots 26, 28 or 27, 29 in the linear guides 68, 70 or 69, 71 by means of the force of springs 67. These locking bolts move into the guide slots 26 and 28 or 27 and 29 at those times when the left pair of pivot pins 21, 23 or the right pair of pivot pins 22, 24, i.e. the left pivot shaft 56 or the right pivot shaft 67, leave the guides 26, 28 or 27, 29. In this way, an unintentional actuation of the pneumatic cylinders 43 and 44, which would move the locking supports 41 and 42 and would make possible a release of a pivot shaft 56 or 57 which is in operation is prevented. In the course of pivoting back the bidirectional pivot frame 1 from a left or right work position, as shown in FIGS. 1 and 2, and into the position of rest shown in FIGS. 1 and 2 FIGS. 3 and 4, the locking bolts 62, 64 or 63, 65 are pushed back from their right work position, shown in FIG. 1, or their left work position shown in FIG. 2 into their position of rest shown in FIG. 4 by the respective pair of pivot pins 21, 23 or 22, 24 against the force of the respective spring 67 and parallel with the vertical longitudinal axis of each guide 26 and 28 or 27 and 29. When the locking bolts 62 and 64 or 63 and 65 are in their extended positions, the locking supports 41 or 42 cannot be shifted in a manner that would allow the pivot shafts 56 or 57 to drop out of the guide slots 26 and 28 or 27 and 29 since the locking bolts extend down into the slots and would prevent sliding movement of the locking supports 41 and 42.

While a preferred embodiment of a method and apparatus for pivoting a bidirectional pivot frame in accordance with the present invention has been set forth fully and completely hereinabove, it will be apparent to one of skill in the art that a number of changes in, for example, the drives for the paper web rolls, the type of printing press being used, the source of compressed air for the cylinders and the like could be made without departing from the true spirit and scope of the present invention which is accordingly to be limited only by the following claims.

What is claimed is:

1. A method for pivoting a bidirectional pivot frame of a paper roll changing device in a web-fed printing press including:

providing a bidirectional pivot frame having first and second ends;

positioning axially extending first and second end pivot pins on said first and second ends of said bidirectional pivot frame;

forming first and second end pivot pin receiving guide slots in spaced side frames of said paper roll changing device;

supporting horizontally shiftable locking devices on said spaced side frames; and positively securing selectively said first and second pivot pins in said first and second end pivot pin receiving guide slots by shifting said locking devices toward said first and second ends of said bidirectional pivot frame.

2. A bidirectional pivot frame of a paper roll changing device comprising:

spaced first and second lateral frame elements each having first and second ends;

first and second pressure rollers supported between said first and second lateral frame elements;

first and second pivot pins secured to said first and second ends of said first and second lateral frame elements at a pin spacing distance, said first pivot pins defining a first pivot axis of said pivot frame and said second pivot pins defining a second pivot axis of said pivot frame;

first and second slidable locking supports on spaced side frames of said paper roll changing device, each of said slidable locking supports having an active operational length greater than said pin spacing distance; and means for shifting said locking supports into cooperative engagement selectively with said first and second pivot pins to form first and second pivot shafts for said bidirectional pivot frame.

3. The bidirectional pivot frame of claim 2 further including spaced first and second guide slots on each of said spaced side frames, said first guide slots receiving said second pivot pins.

4. The bidirectional pivot frame of claim 2 wherein said slidable locking supports are disposed on outside surfaces of said spaced side frames and further including means for shifting said first and second locking supports horizontally together.

5. The bidirectional pivot frame of claim 2 further including spaced guide rollers on said spaced side frames, said guide rollers supporting said locking supports for movement on said side frames.

6. The bidirectional pivot frame of claim 3 further including linear guides secured to said side frames above said guide slots, each of said linear guides having a locking bolt which is shiftable in its linear guide into its associated one of said guide slots.

* * * * *